US011206940B2

(12) United States Patent
Kaechele

(10) Patent No.: US 11,206,940 B2
(45) Date of Patent: Dec. 28, 2021

(54) SECURE CONTAINER FOR RECEIVING AND PREVENTING UNAUTHORIZED ACCESS TO ARTICLES

(71) Applicant: Darryl Reed Kaechele, Calgary (CA)

(72) Inventor: Darryl Reed Kaechele, Calgary (CA)

( * ) Notice: Subject to any disclaimer, the term of this patent is extended or adjusted under 35 U.S.C. 154(b) by 59 days.

(21) Appl. No.: 16/742,426

(22) Filed: Jan. 14, 2020

(65) Prior Publication Data

US 2020/0237132 A1 Jul. 30, 2020

Related U.S. Application Data

(60) Provisional application No. 62/796,285, filed on Jan. 24, 2019.

(51) Int. Cl.
*A47G 29/22* (2006.01)
*A47G 29/30* (2006.01)
(Continued)

(52) U.S. Cl.
CPC ..... *A47G 29/22* (2013.01); *A47G 29/1251* (2017.08); *A47G 29/12095* (2017.08); *A47G 29/28* (2013.01); *A47G 29/30* (2013.01)

(58) Field of Classification Search
CPC ..... A47G 29/16; A47G 29/22; A47G 29/28; A47G 29/30; A47G 29/1248; A47G 29/1251; A47G 29/1254; A47G 29/1209; A47G 29/12095; A47G 29/12; A47G 29/141; A47G 2029/1257; A47G 2029/148; A47G 2029/149; A47G 2201/0285
(Continued)

(56) References Cited

U.S. PATENT DOCUMENTS 88,528 A * 3/1869 Strong ..... A47G 29/16 232/51
384,154 A * 6/1888 Harrigan ..... A47G 29/1207 232/49
(Continued)

OTHER PUBLICATIONS

Home Depot, "ParcelWirx Graphite Wall/Ground Mount Secure Dropbox", downloaded on Jan. 13, 2020 from https://www.homedepot.ca/product/parcelwirx-graphite-wall-ground-mount-secure-dropbox/1001102904?rec=true.
(Continued)

*Primary Examiner* — William L Miller
(74) *Attorney, Agent, or Firm* — ATMAC Patent Services Ltd.; Andrew T. MacMillan

(57) ABSTRACT

An apparatus for receiving and preventing unauthorized access to deliveries has an enclosure, a moveable roof on the enclosure, a rotatable basket within the enclosure, and a connecting member coupling motion of the roof and the basket. The basket is rotatable between an upright and an upside-down position. The roof is moveable between an open position in which the basket is accessible and a closed position in which the basket access is blocked. When the roof is moved to the open position, the connecting member rotates the basket to the upright position thereby allowing a user to place the article into the basket. Moving the roof to the closed position rotates the basket to the upside-down position thereby causing the article to drop out of the basket towards the bottom of the enclosure. The enclosure may open into a chute or building for delivering the parcels to a remote location.

20 Claims, 8 Drawing Sheets

(51) Int. Cl.
*A47G 29/28* (2006.01)
*A47G 29/12* (2006.01)
*A47G 29/124* (2006.01)

(58) Field of Classification Search
USPC ..... 232/17, 19, 35, 43.5, 45, 47–52; 193/8
See application file for complete search history.

(56) References Cited

U.S. PATENT DOCUMENTS 445,497 A * 1/1891 Catudal et al. .. A47G 29/12095 232/47
720,651 A * 2/1903 Aarseth ..... A47G 29/12095 232/33
890,766 A * 6/1908 Hann ..... A47G 29/16 232/51
1,155,146 A * 9/1915 Graves ..... A47G 29/1209 232/49
1,237,199 A * 8/1917 Graves ..... A47G 29/1209 232/49
1,583,168 A * 5/1926 Pennig ..... A47G 29/12 232/19
1,667,503 A * 4/1928 Wemhoener ..... A47G 29/12 232/19
3,519,198 A * 7/1970 Benoliel ..... A47G 29/22 232/17
5,435,484 A * 7/1995 Carlson ..... A47G 29/1251 232/47
6,347,737 B1 * 2/2002 Madruga ..... A47G 29/22 232/34
6,375,070 B1 * 4/2002 Snoke ..... A47G 29/141 232/20
7,175,071 B1 * 2/2007 Slagle ..... A47G 29/16 220/833
7,182,246 B1 * 2/2007 Sievel ..... A47G 29/22 232/45
7,428,980 B2 * 9/2008 Irwin ..... E05G 7/001 232/45
8,020,752 B2 * 9/2011 Hjorth ..... A47G 29/1251 232/47
8,573,473 B1 * 11/2013 Farentinos ..... A47G 29/22 232/51
9,004,346 B2 4/2015 Farentinos et al.
10,251,503 B1 * 4/2019 Fulps ..... A47G 29/12
10,517,417 B2 * 12/2019 Kutas ..... A47G 29/1251
2004/0140347 A1 * 7/2004 Mihaylov ..... A61L 2/10 232/31
2009/0014509 A1 * 1/2009 Miller ..... A47G 29/1201 232/31
2009/0314828 A1 * 12/2009 Hjorth ..... A47G 29/1251 232/44

OTHER PUBLICATIONS

Home Depot, "Architectural Mailboxes Elephantrunk Parcel Drop Box Black", downloaded on Jan. 13, 2020 from https://www.homedepot.ca/product/architectural-mailboxes-elephantrunk-parcel-drop-box-black/1000769314.

* cited by examiner

SECURE CONTAINER FOR RECEIVING AND PREVENTING UNAUTHORIZED ACCESS TO ARTICLES

CROSS-REFERENCE TO RELATED APPLICATIONS

This application claims the benefit of priority of U.S. Provisional Application No. 62/796,285 filed Jan. 24, 2019, which is incorporated herein by reference.

BACKGROUND OF THE INVENTION

(1) Field of the Invention

The invention pertains generally to an apparatus for receiving articles from delivery services and preventing unauthorized access to the articles.

(2) Description of the Related Art

Parcels delivered to residential addresses are often left unattended and unsecured outside the building when the occupants are not present to receive the deliveries. Unattended and unsecured parcels are prone to thievery or vandalism as they are an easy target for someone with a malicious intent. In addition, articles left outside the building may be damaged by rain, snow, or wind.

To avoid these issues, some people may choose to have their parcels delivered to their workplace; however, it is not convenient for everyone to receive parcels at work. Receiving deliveries of employee's personal belongings can create an additional burden for workplaces as it would take extra resources from the company's shipping and receiving department. Alternatively, parcels can be delivered to a dedicated delivery facility; however, the dedicated delivery facilities usually have a secondary location and may have limited hours of access making it inconvenient or even unfeasible to get the parcels in a timely manner. This can be particularly critical when the parcels have a time-sensitive content. People may also have difficulties transporting large or heavy items between their workplace or dedicated delivery facility and their home.

As another alternative, the parcels can be placed into a delivery container located at the recipient's address that requires a key or an electronic code to open a locked compartment; however, requiring a key or a code creates logistic issues and may cause delays because additional coordination is required between the recipient and the courier company. If the recipient is expected to receive parcels from multiple courier companies, the recipient would likely need multiple copies of the key for each of the courier company which would create more hassle. Some entry doors to a building may be equipped with a Wi-Fi lock and one-time code may be issued to the courier company for delivering the parcel into the house; however even one-time access to one's resident by a stranger is not recommended as there may be children or pets in the house that may be disturbed by a stranger entering their home.

In some cases, people may prefer to install a security camera for surveillance; however, security cameras do nothing to secure the parcels or protect the parcel from the weather.

BRIEF SUMMARY OF THE INVENTION

According to an exemplary embodiment of the invention there is an apparatus for receiving an article. The apparatus includes an enclosure with a top opening through a top of the enclosure, a basket located at least partially within the enclosure and rotatably coupled to the enclosure, a roof of the enclosure moveable between an open position and a close position, and a connecting member coupling the roof with basket. The basket is rotatable between an upright position in which a basket opening is rotated towards the top opening of the enclosure and an upside-down position in which the basket opening is rotated towards a bottom of the enclosure. In the open position the basket is accessible from an outside of the enclosure through the top opening. In the closed position the roof blocks access to the basket from the outside of the enclosure. The connecting member is configured such that movement of the roof to the open position rotates the basket to the upright position thereby allowing a user to place the article into the basket and movement of the roof to the closed position rotates the basket to the upside-down position thereby causing the article to drop out of the basket towards the bottom of the enclosure.

According to an exemplary embodiment of the invention a method for receiving an article. The method includes providing an enclosure with a top opening through a top of the enclosure, providing a basket located at least partially within the enclosure and rotatably coupling the basket to the enclosure, providing a roof of the enclosure moveable between an open position and a closed position, and providing a connecting member coupling the roof with the basket. The basket is rotatable between an upright position in which a basket opening is rotated towards the top opening of the enclosure and an upside-down position in which the basket opening is rotated towards a bottom of the enclosure. In the open position the basket is accessible from an outside of the enclosure through the top opening. In the closed position the roof blocks access to the basket from the outside of the enclosure. The connecting member is configured such that moving the roof to the open position rotates the basket to the upright position thereby allowing a user to place the article into the basket and moving of the roof to the closed position rotates the basket to the upside-down position thereby causing the article to drop out of the basket towards the bottom of the enclosure.

These and other advantages and embodiments of the present invention will no doubt become apparent to those of ordinary skill in the art after reading the following detailed description of preferred embodiments illustrated in the various figures and drawings.

BRIEF DESCRIPTION OF THE DRAWINGS

The invention will be described in greater detail with reference to the accompanying drawings which represent preferred embodiments thereof.

DETAILED DESCRIPTION

Figure 1:
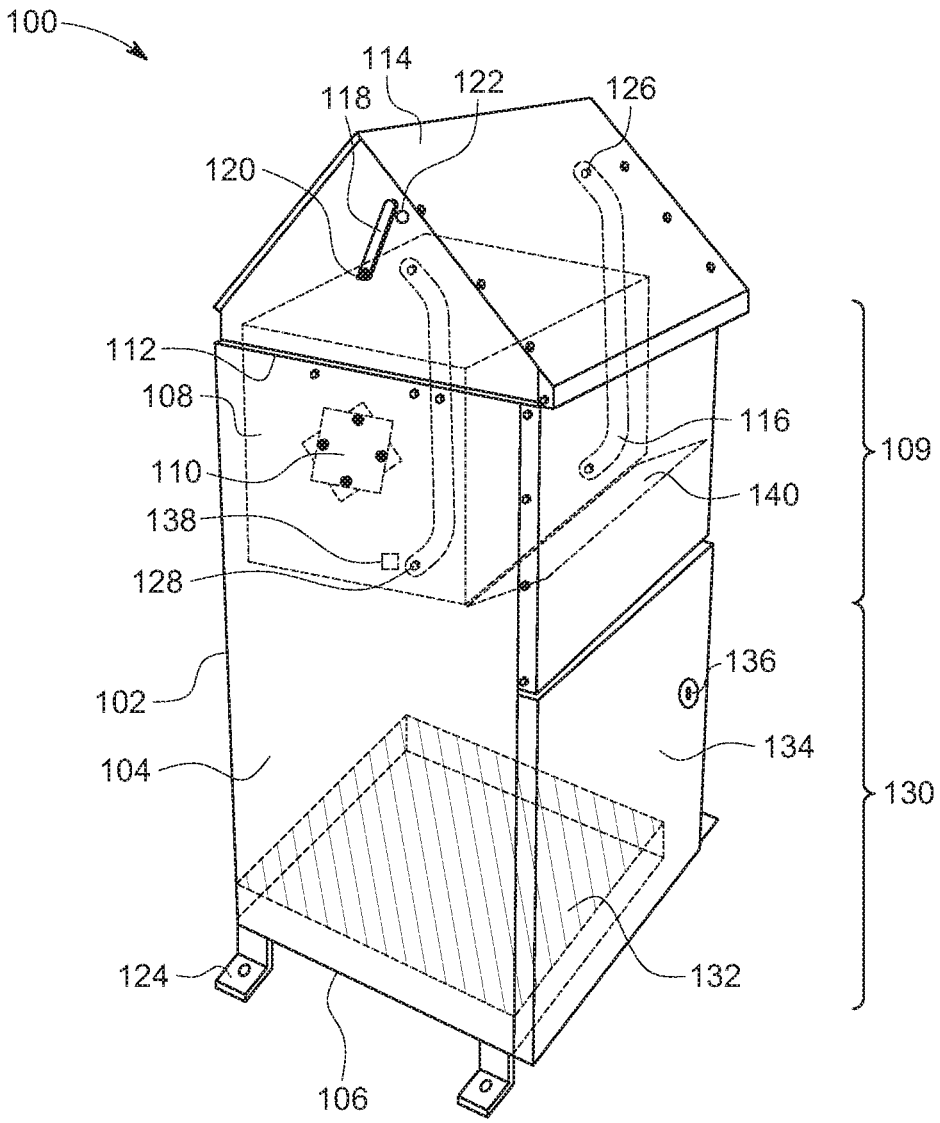
FIG. 1 shows a perspective view of a first exemplary embodiment of an apparatus for receiving and storing articles with the roof in the closed position, the basket in the upside-down position, and the indicator pointing up.

FIG. 1 shows an exemplary embodiment of an apparatus 100 for receiving articles or parcels. The apparatus 100 has an enclosure 102 formed by sidewalls 104 and a base 106; a top opening is formed on an upward facing side of the enclosure 102 by the sidewalls 104. A basket 108 for receiving articles is rotatably coupled to an upper portion 109 of the enclosure 102 with turntable bearings 110 on an inner-side surface of the enclosure 102 and an outer surface of the basket 108. The turntable bearings 110 are attached to the enclosure 102 by very high bond tape and a machine screw and locknut assembly. The use of machine screw and locknut assembly is advantageous because it would require two wrenches and access from within the enclosure 102 to undo the machine screw and locknut assembly making it much more difficult to gain access to the enclosure 102. In a preferred embodiment, the turntable bearings 100 are securely connected to the enclosure 102 to prevent someone from removing the bearings 110 and as a result removing the basket 108 from the enclosure 102 gaining access to the enclosure 102.

A roof 114 with a gable shape is connected to the upper portion 109 of the enclosure 102 with a roof hinge. The roof 114 in a closed position as illustrated in FIG. 1 blocks access to the basket 108 and protects an inside of the enclosure 102 from rain, snow, and dust.

Connecting members 116 being rigid arms in this configuration couple the motion of the roof 114 and the basket 108 such that opening and closing the roof 114 also rotates the basket 108. The connecting members 116 are rotatably coupled to the roof 114 at a first end 126 and rotatably coupled to the basket 108 at a second end 128.

On the roof 114, there is an indicator 118 used for notifying if a parcel has been delivered to the apparatus 100. The indicator 118 is rotatably coupled with a pivot 120 to a side of the roof 114. Initially the indicator 118 on the roof 114 is pointing up and resting against an indicator stop 122 in an initial position, indicating the roof 114 has not been opened implying there are no articles in the enclosure 102. The apparatus 100 has anchors 124 attached to the base 106 of the enclosure 102 to secure the apparatus 100 to the ground to prevent undesired movement of the apparatus 100.

The basket 108 delivers the articles to a lower portion 130 of the enclosure 102. The apparatus 100 also includes an enclosure stop 112, a cushion 132, a door 134, a door lock 136, a basket stop 138, and a deflecting surface 140.

Figure 2:
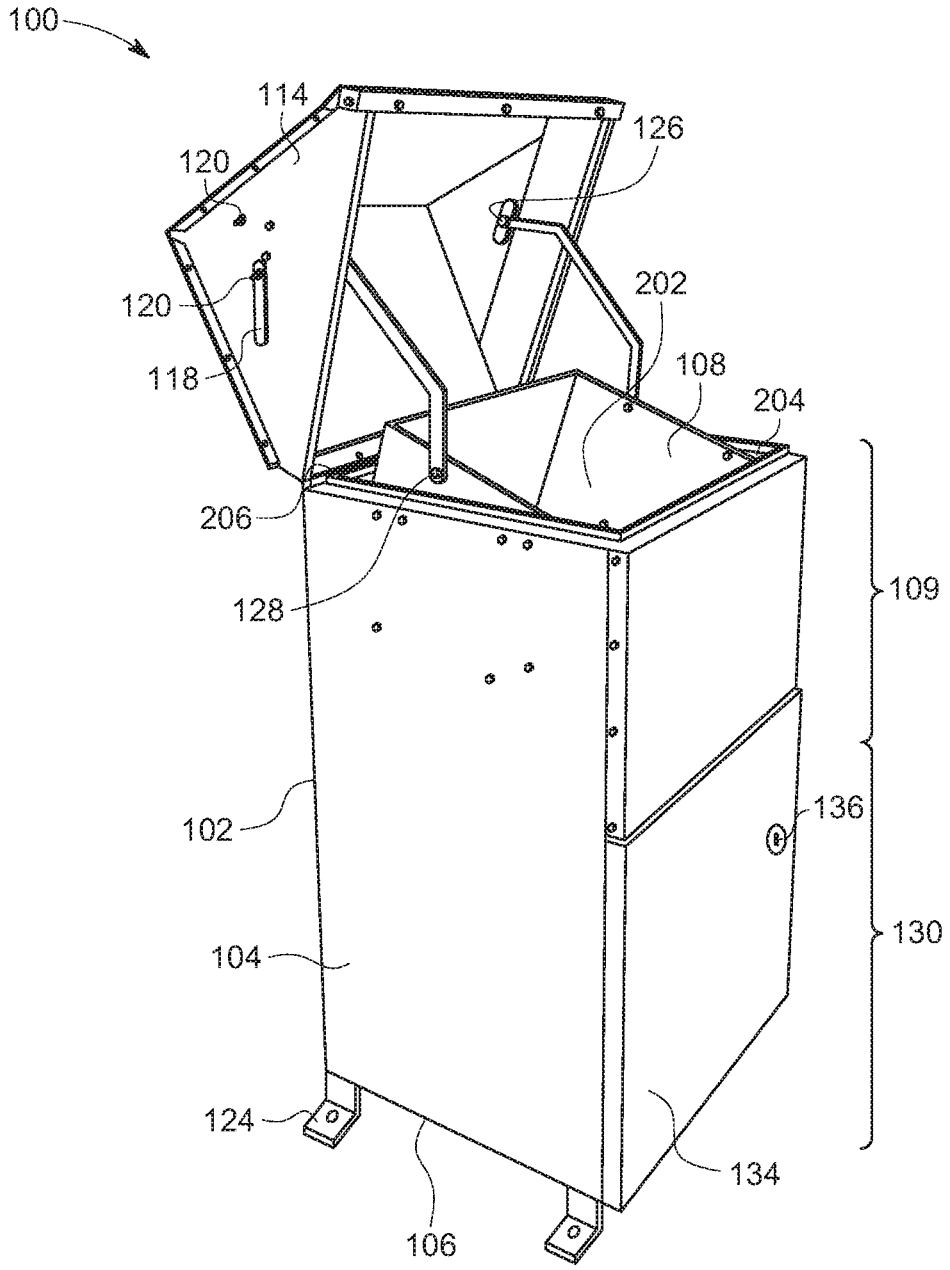
FIG. 2 shows a perspective view of the apparatus of FIG. 1 with the roof in the open position and the basket in the upright position.

FIG. 2 show the apparatus 100 of FIG. 1 when the roof 114 is in an open position and the basket 108 is in an upright position. When viewing the apparatus 100 from the angle illustrated in FIG. 2, the roof 114 is rotated in a counter-clockwise direction about the roof hinge 206 from the closed position to the open position. As the roof 114 moves from the closed position to the open position, the connecting members 116 rotate the basket 108 counter-clockwise from an upside-down position to the upright position; the connecting members 116 couple the movement of the roof 114 and the position of the basket 108. In the upright position, a basket opening 202 is aligned with the top opening 204 through top of the enclosure 102. The basket opening 202 and top opening 204 are aligned to maximize the size of the article that can be placed within the basket 108. The top opening 204 is advantageous over loading from the side. Circular parcels are easier to load from the top opening 204 and the parcels are less likely to spill out of the basket in case the basket 108 overflows.

Figure 3:
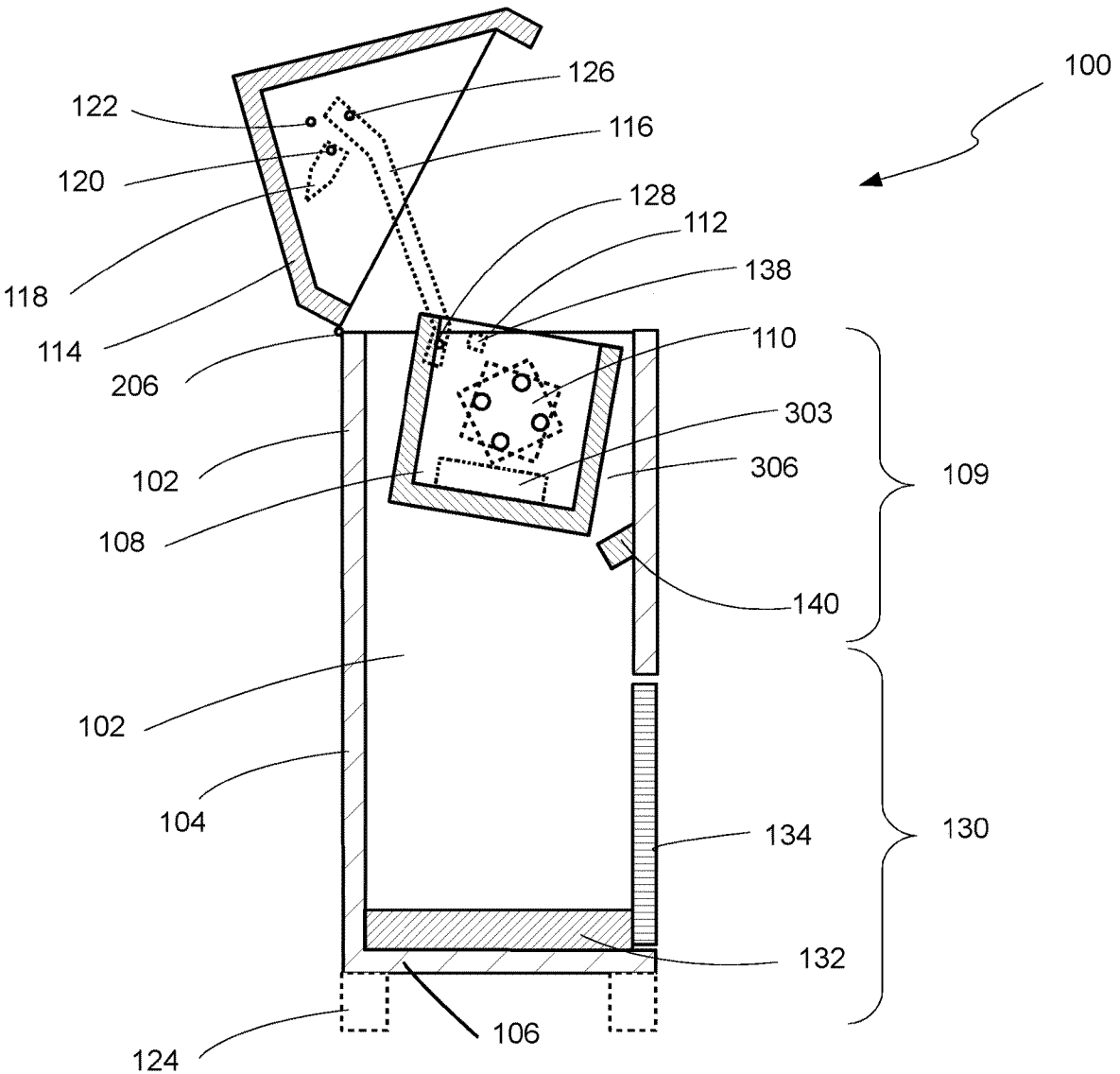
FIG. 3 shows a side sectional view of the apparatus of FIG. 1 with the roof in the open position such that the basket can be loaded with the article to be delivered.

FIG. 3 shows a side sectional view of the apparatus 100 when the roof 114 is in the open position and the basket 108 is in the upright position. In this exemplary embodiment, the basket stop 138 on either side of the basket 108 prevents the basket 108 from rotating further in the counter-clockwise direction past the upright position; the basket stop 138 is attached to the outer surface of the basket 108. The basket stop 138 impacts the enclosure stop 112 upon the basket 108 being rotated into the upright position by movement of the roof 114 to the open position; a top edge of the sidewalls 104 acts as the enclosure stop 112 in this embodiment.

In the open position, the roof 114 has a center of gravity such that the roof 114 under the force of gravity attempts to rotate further in the counter-clockwise direction past the open position. Since the movement of the roof 114 is coupled to rotation of the basket 108 by the connecting member 116, the roof 114 also attempts to rotate the basket 108 past the upright position in the counter-clockwise direction. The basket stop 138 on the basket 108 upon impacting the enclosure stop 112 prevents the basket 108 from continuing past the upright position and holds the roof 114 in the open position. By holding the roof 114 in the open position and keeping the basket 108 in the upright position, the user can use both their hands for loading one or more articles into the basket 108. The basket opening 202 is accessible from outside of the enclosure 102 when the roof 114 is in the open position. With the roof 114 in the open position and the basket opening 202 is aligned with the top opening 204 of the enclosure 102, the basket 108 can easily receive an article 303 from the user. The design of the apparatus 100 is such that multiple articles 303 can be easily loaded through the basket opening 202 at the same time.

When the roof 114 is completely open as shown in FIG. 3 or partially open, someone may attempt to view the content in the lower portion 130 of the enclosure 102 or may even attempt to retrieve delivered items through a gap 306 between the enclosure 102 and the basket 108. In this exemplary embodiment, the deflecting surface 140 provided below the basket 108 is used to prevent access to the lower portion 130 of the enclosure 102. The deflecting surface 140 extends toward an inner area of the enclosure 102 from an inner-side surface of the enclosure 102 and obstructs access through the gap 306 between the enclosure 102 and the basket 108. The basket opening 202 itself, however, is unobstructed by the deflecting surface 140 when the basket 108 is rotated into the upside-down position. In other words, the deflecting surface 140 does not impede the article 303 in the basket 108 from falling out of the basket 108 when the basket 108 is in the upside-down position. The deflecting surface 140 prevents someone from reaching into the lower portion 130 of the enclosure 102 through the gap 306 between the basket 108 and the enclosure 102 when the roof 114 is in the open or partially open position. The deflecting surface 140 is particularly advantageous when the roof 114 is in the partially open position and the basket opening 202 is facing the sidewall 104 as there is maximum gap between the sidewall 104 and the basket 108 in this configuration. The deflecting surface 140 block access through the gap 306.

Figure 4:
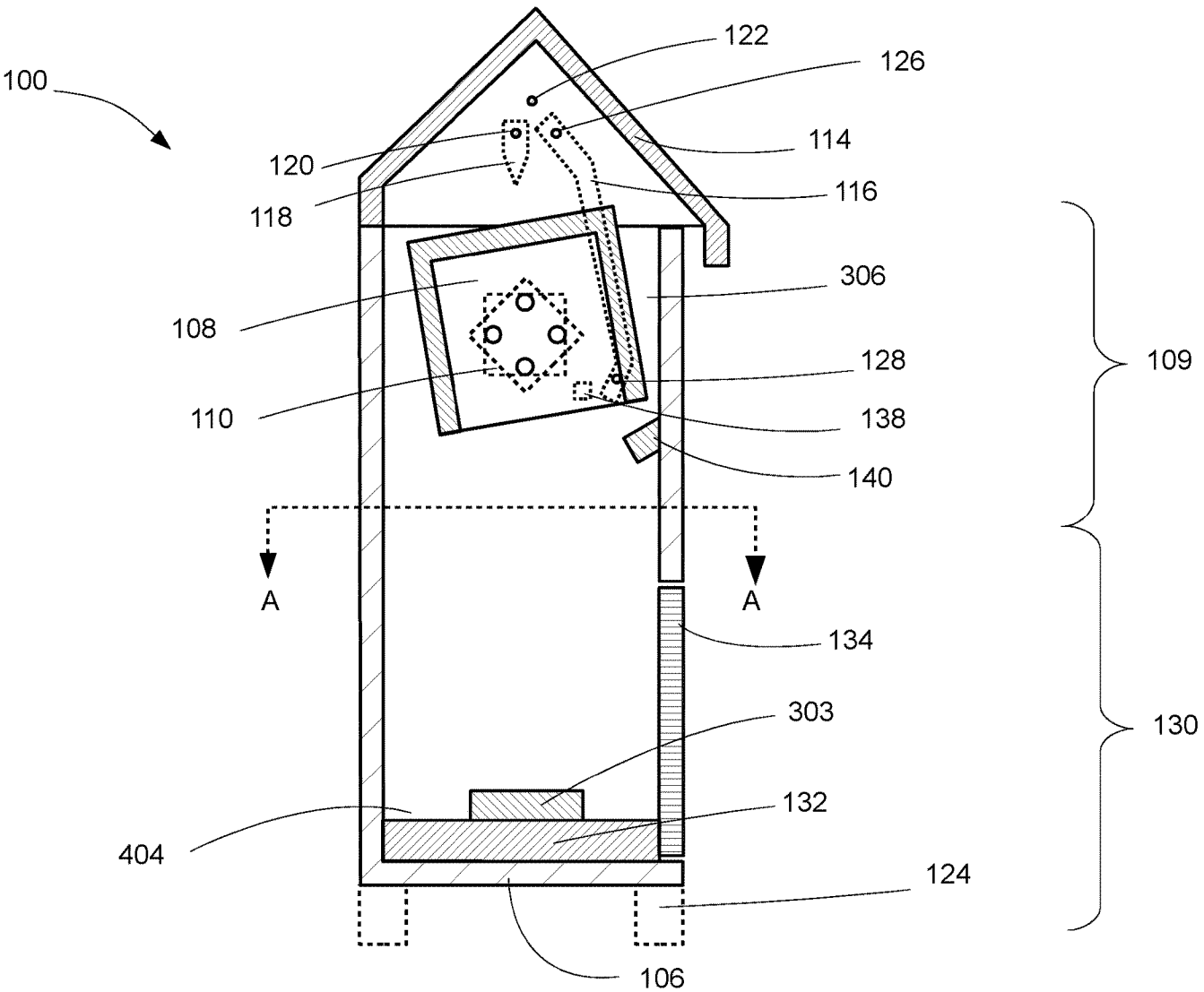
FIG. 4 shows a side sectional view of the apparatus of FIG. 1 with the roof in the closed position and the basket in the upside-down position such that the basket drops the article to the base of the enclosure.

FIG. 4 shows a side sectional view of the apparatus 100 when the roof 114 is in a closed position, the basket 108 is in the upside-down position, and the indicator 118 is pointing down in a position implying delivery. After loading the basket 108 in the open position with the article 303 to be delivered, the roof 114 is moved clockwise around the hinge 206 by the user from the open position to the closed position. As the roof 114 is moved clockwise from the open position to the closed position, the connecting members 116, which couple the movement of the roof 114 and the basket 108, rotate the basket 108 clockwise and thereby move the basket 108 from the upright position to the upside-down position. As the basket opening 202 is rotated towards a bottom 404 of the enclosure 102, the basket 108 drops the article 303 to the lower portion 130 of the enclosure 102.

In the embodiment presented in FIG. 1, the base 106 of the enclosure has the cushion 134 on the inner-surface to avoid damage to the article 303.

As the roof 114 is moved from the closed position to the open position, the indicator 118 is rotated under the force of gravity about the pivot 120 rotatably coupling the indicator 118 with the roof 114. When the roof 114 is closed, the indicator 118 points down in the position implying delivery. When the indicator 118 is pointing down it implies the roof 114 of the enclosure 102 was opened for delivering articles 303 to the apparatus 100. The roof 114 in the closed position prevents access to the enclosure 102 through the top opening 204 of the enclosure 102.

Figure 5:
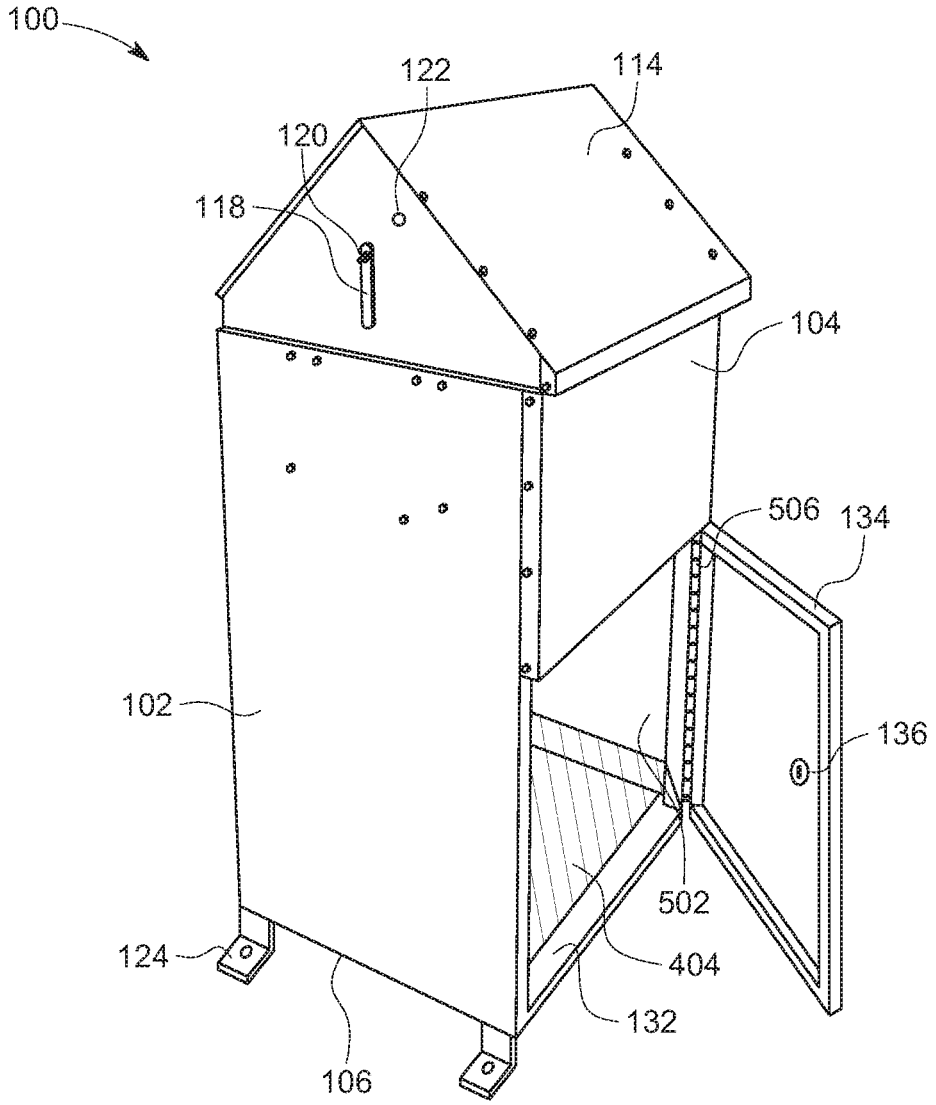
FIG. 5 shows a perspective view of the embodiment in FIG. 1 with door in the ajar position thereby allowing the enclosure to be accessed through the side opening to retrieve the articles.

FIG. 5 shows the apparatus 100 of FIG. 1 having a side opening 502 in the sidewall 104 of the enclosure 102 which provides access to the lower portion 130 of the enclosure 102 for retrieving articles 303. The door 134 is rotatably coupled to the lower portion 130 of the enclosure 102 with a door hinge 506 for restricting access through the side opening 502. The door hinge 506 is mounted to the enclosure 102 so that the fasteners used to fasten the door hinge 506 to the enclosure 102 are not accessible when the door 134 is in a shut position. This feature improves the overall security of the apparatus 100 as concealing the fasteners makes it difficult to tamper with the apparatus 100 and access the lower portion of the enclosure 130.

The door lock 136 restricts the door 134 to the shut position until it is unlocked by an authorized person. Once the door 134 is unlocked, the door 134 in an ajar position allows access to the lower portion 130 of the enclosure 102 through the side opening 502. In the ajar position, articles 303 can be retrieved from the lower portion 130 of the enclosure 102 and the door 134 can be shut and locked. After removing the articles 303, the indicator 118 can be manually set to the initial position. The initial position indicates the roof 114 has not been opened since the articles 303 were cleared out from the enclosure 102 and therefore it is unlikely that new parcels 303 were delivered since.

Figure 6:
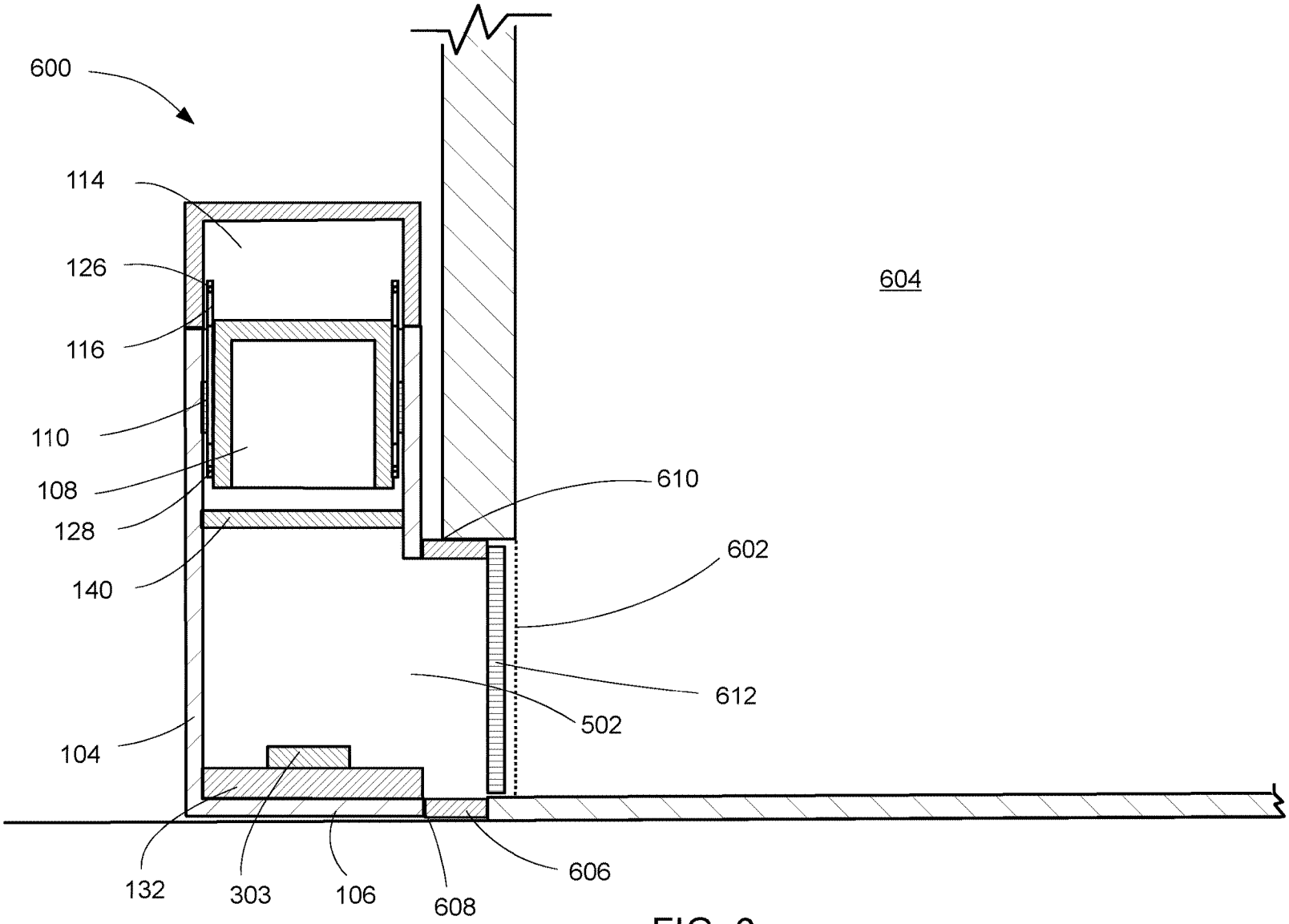
FIG. 6 shows a front sectional view of an apparatus for receiving and storing articles where the side opening can be accessed from a building according to an exemplary embodiment.

FIG. 6 shows a front sectional view of an apparatus 600 for receiving articles where the side opening 502 in the sidewall 104 of the enclosure 102 can be accessed from a building opening 602 within a building 604. An enclosed bridge 606 is used to connect the side opening 502 of the enclosure 102 with the building opening 602. The enclosed bridge 606 surrounds the side opening 502 by connecting to an outer surface of the enclosure 102 at a first end 608 of the enclosed bridge 606 and surrounds the building opening 602 by connecting to an outer surface of the building 604 at a second end 610 of the enclosed bridge 606. The enclosed bridge 606 blocks outside access to the lower portion 130 of the enclosure 102 and the building 604. The enclosed bridge 606 is also used for anchoring the building 604 and the apparatus 600 to prevent removal of the apparatus 600 similar to the anchor 124 in FIG. 1. In the embodiment illustrated in FIG. 6, the roof 114 is coupled to the enclosure 102 such that the roof 114 can be opened and closed without interfering or otherwise impacting with the building 604. In other words, there is enough clearance between the apparatus 600 and the building 604 such that the building 604 will not impede or prevent the roof 114 from moving between the open position and the closed position.

The building opening 602 provides access to the lower portion 130 of the enclosure 102 via the enclosed bridge 606; a building opening door 612 located within the building 604 restricts access to the lower portion 130 of the enclosure 102 through the building opening 602. The building opening door 612 also acts as an additional barrier to the building 604 if the apparatus 600 were to be removed. In embodiments that include the building opening door 612, the building opening door 612 beneficially restricts access through the building opening 602 by preventing access to the building 604 gained through the building opening 602.

To retrieve the deliveries 303 from the lower portion 130 of the enclosure 102, an authorized person enters the building 604 and opens the building opening door 612 to access the lower portion 130 of the enclosure 102. The deliveries 303 can be retrieved from the lower portion 130 of the enclosure 102 by reaching through the enclosed bridge 606.

The apparatus 600 of FIG. 6 is different from the apparatus 100 of FIG. 1 by being connected to the building 604 and articles 303 being retrieved from the lower portion 130 of the enclosure 102 from within the building 604. With the apparatus 100 of FIG. 1, access to the lower portion 130 of the enclosure 102 is provided through the door 134 that is coupled to side opening 502 of the enclosure 102. Combinations of these embodiments are also possible where the enclosure sidewalls 104 include multiple side openings 502, namely, one for external access outside of a building 604 and one for internal access from within the building 604.

In another example usage scenario, the apparatus 600 of FIG. 6 can be connected to buildings such as homeless shelters and food banks for receiving donations of food, clothes, toiletries, and other essentials, for example. This embodiment may also be preferred in areas with harsh climates as the articles 303 can be retrieved from the comfort of the building 604.

Figure 7:
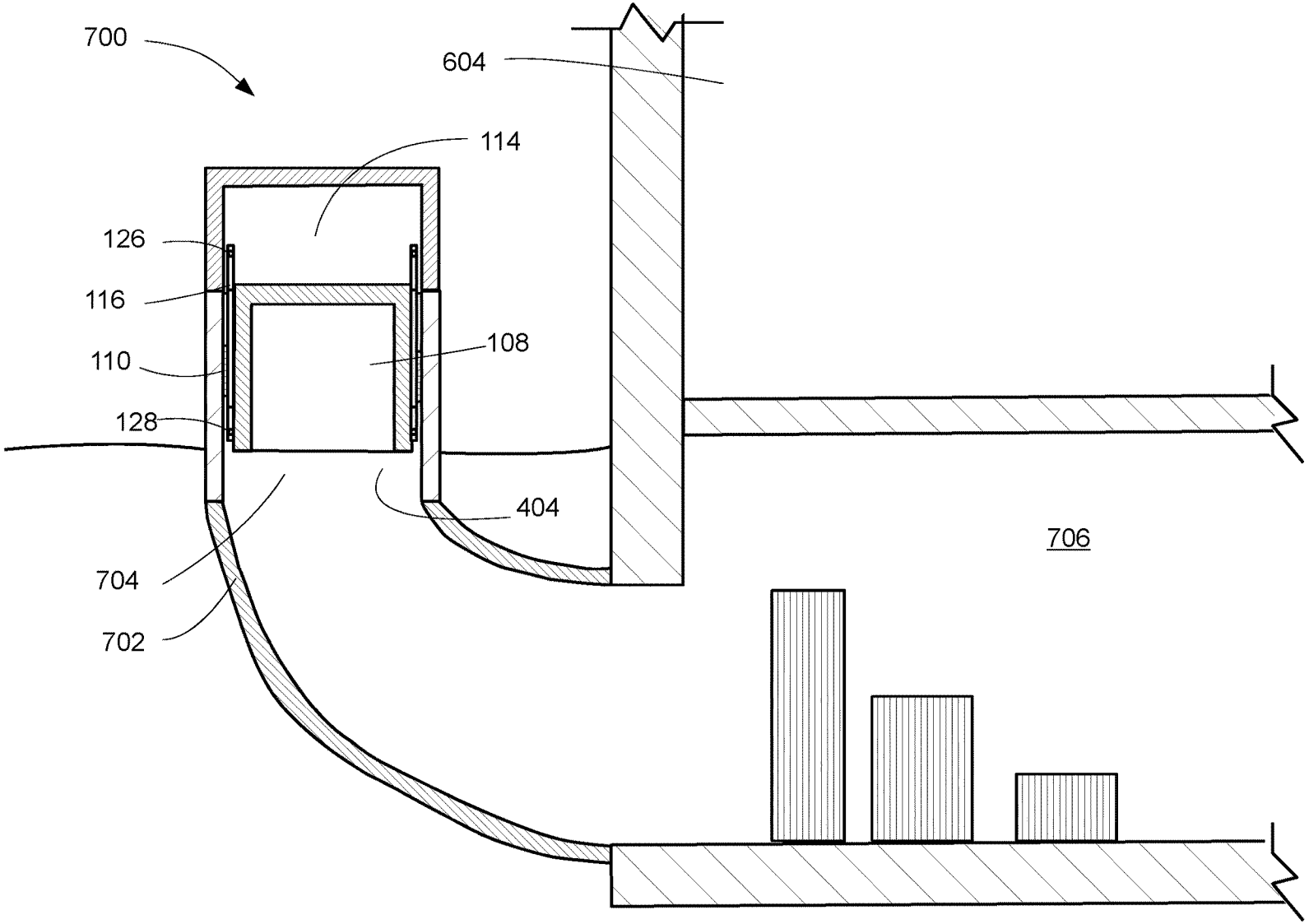
FIG. 7 shows a front sectional view of an apparatus for receiving and storing articles where the apparatus is connected to a parcel reception area via a chute provided on a bottom of the enclosure according to an exemplary embodiment.

FIG. 7 show a front sectional view of an apparatus 700 for receiving articles 303 where the enclosure 102 is formed by the plurality of sidewalls 104 without the base 106 and the apparatus 700 is instead connected to a chute 702. The embodiment illustrated in FIG. 7 does not store the articles 303 within the enclosure 102; instead, the articles 303 delivered to the apparatus 700 in FIG. 7 drop through a bottom opening 704 into a parcel reception area 706 via the chute 702 that connects the apparatus 700 to the parcel reception area 706. The apparatus 700 in FIG. 7 is more compact as the enclosure 102 does not need space for securely storing the parcels 303 as the parcels 303 are directly delivered to the parcel reception area 706 which is secured.

The deflector surface 140 for the purpose of blocking access below the basket 108 can be omitted in this embodiment as the delivered articles 303 are not stored within the enclosure 102. The apparatus 700 is anchored to the chute 702 in this embodiment by means of mechanical fastening. The articles 303 are further sorted in the parcel reception area 706.

The apparatus 700 of FIG. 7 is particularly useful when receiving a large volume of deliveries as the articles 303 can be directly be processed upon delivery and the storage area is independent of the interior volume of the enclosure 102.

In the exemplary embodiments, the sidewalls 104, the basket 108, the roof 114, and the deflector surface 140 are fabricated from flat sheet metal. In other embodiments, further structural rigidity is added to the sheet metal by using thicker material, changing material type, flanging, hemming, embossing, adding structural grooved seams, adding ribs, or using stiffeners/reinforcements. A frame may be formed by metals bars or posts in the shape of the enclosure and then flat sheet metal sheets may be attached to the frame to form the sidewalls 104 and base. Similar to the enclosure 102, the roof 114 may also have any suitable frame for structural rigidity. The use of flat sheet metal makes the apparatus 100 easier to manufacture as the size of the apparatus 100 can be easily scaled by changing the size of the sheet metal.

Figure 8:
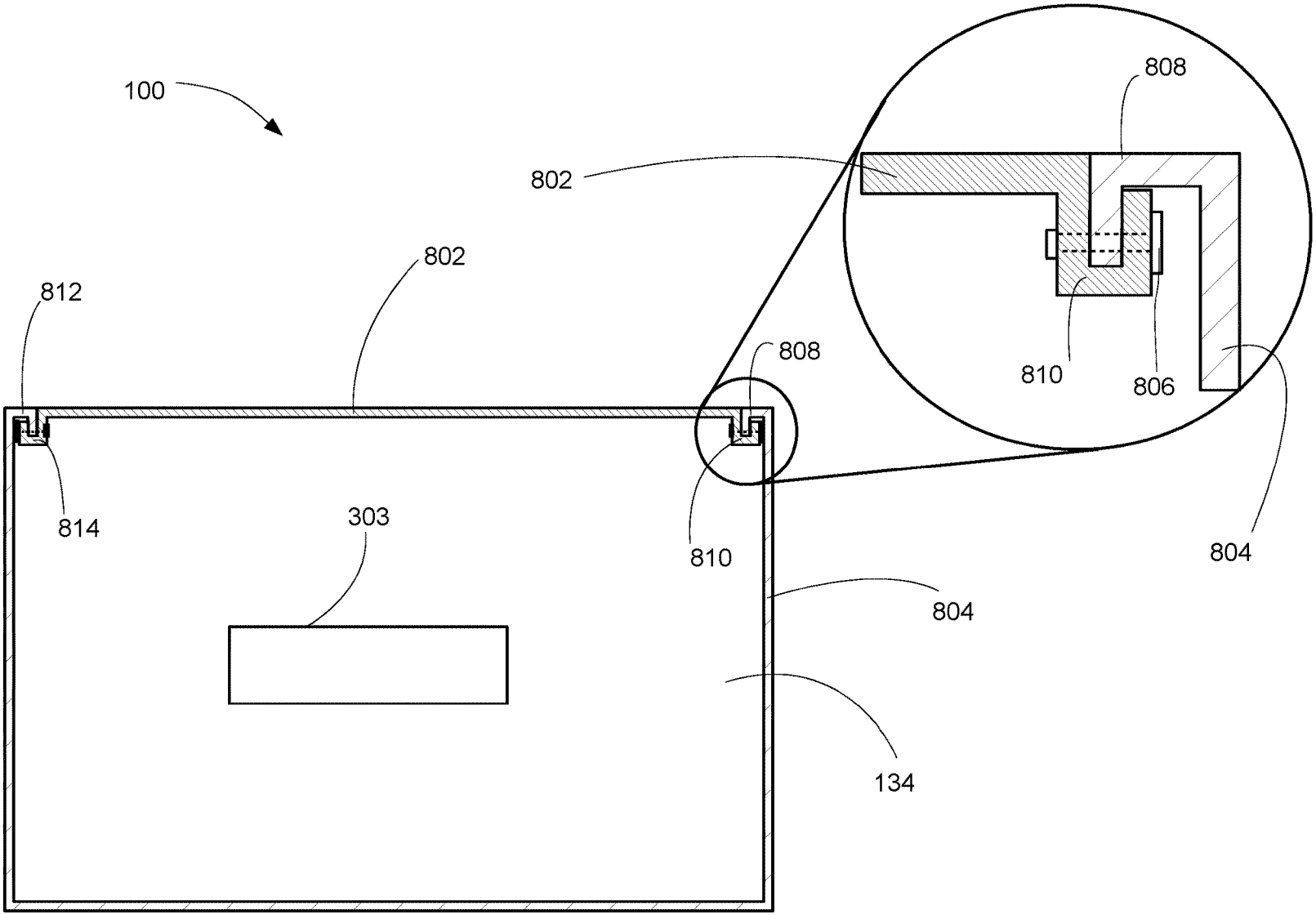
FIG. 8 shows a top section view of FIG. 4 across the section line A-A.

FIG. 8 shows a top section view of FIG. 4 across the section line A-A. The sidewall 104 comprises of a first sidewall 802 and a second sidewall 804. The first sidewall 802 is a flat sheet and the second sidewall 804 has two right-angle bends forming a U-shape. A first end 808 of the first sidewall 802 is connected to a first end 810 of the second sidewall 804 using a standing seam technique. A second end 812 of the first sidewall 802 is connected to a second end 814 of the second sidewall 804 using a standing seam technique. When the first sidewall 802 and the second sidewall 804 are connected, they form a rectangular prism with two open ends. As an additional security measure, the first sidewall 802 and the second sidewall 804 are further secured by fastening the standing seam with rivets 806. The sheet metal configured in this manner ensures that the rivets 806 are concealed and not accessible from outside of the enclosure 102 to improve the overall appearance and security of the apparatus 100.

According to an exemplary embodiment, an apparatus 100 for receiving and preventing unauthorized access to deliveries 303 has an enclosure 102, a roof 114 on the enclosure 102, a basket 108 which is rotatable within the enclosure 102, and a connecting member 116 coupling motion of the roof 114 and the basket 108. The basket 108 is rotatable between an upright position and an upside-down position. The roof 114 is moveable between an open position in which the basket 108 is accessible and a closed position in which the basket 108 access is blocked. When the roof 114 is moved to the open position, the connecting member 116 rotates the basket 108 to the upright position thereby allowing a user to place an article 303 into the basket 108. Moving the roof 114 to the closed position rotates the basket 108 to the upside-down position thereby causing the article 303 to drop out of the basket 108 towards the bottom 404 of the enclosure 102. The enclosure 102 may open into the chute 702 or the building 604 for delivering the parcels 303 to a remote location.

Although the invention has been described in connection with preferred embodiments, it should be understood that various modifications, additions and alterations may be made to the invention by one skilled in the art without departing from the spirit and scope of the invention.

In the previously described embodiments, the connecting member 116 coupling the motion of the roof 114 and the basket 108 is a rigid arm. However, in some embodiments, other types of connecting members 116 are utilized. For example, the connecting members 116 may be made using a chain, a flexible arm, a rope, a belt, a wire, a cable, springs, a slider crank mechanism or a combination thereof. Although the previously described embodiments have two connecting members 116, in some embodiments, there is at least one connecting member 116 for coupling the motion of the roof 114 and the basket 108. In other embodiments, the connecting members 116 are omitted, and the basket 108 has a handle for rotating the basket 108 within the enclosure 102.

In the previously described embodiments, the basket opening 202 was described as being rotated towards the bottom 404 of the enclosure 102. If the enclosure 102 has the base 106, the bottom 404 of the enclosure 102 means it is rotated towards the base 106 of the enclosure 102 as in the embodiment described in FIGS. 1-6. If the enclosure 102 does not have the base 106, the bottom 404 of the enclosure 102 is towards the bottom direction of the enclosure 102 as in the embodiment described in FIG. 7; the parcels 303 fall through the bottom opening 704 which opens into the chute 702 that leads to the parcel reception area 706 or a secure storage room.

In other embodiments, the movement of the roof 114 and the rotation of the basket 108 are automated utilizing a motor coupled to the basket 108 and/or the roof 114. For instance, in some embodiments, when a button is pressed, the roof 114 is opened and the basket 108 is rotated to the upright position as the motion of the basket 108 and the roof 114 are coupled by the connecting members 116. Pressing the button again or pressing another button closes the roof 114 and rotates the basket 108 to the upside-down position dropping the articles 303 to the bottom 404 of the enclosure 102. The motor may directly drive either one of the roof 114 or the basket 108 and the connecting member(s) 116 transfer rotation of one to rotation of the other. In some embodiments, separate motors drive each of the roof 114 and the basket 108 separately and the connecting member 116 is omitted. In some embodiments, the apparatus has a timer coupled to one or motors to automatically close the roof 114 after a set-time period to prevent water from entering the enclosure 102 and damaging the articles 303.

In the previously described embodiments, the indicator 118 is coupled to the roof 114 with the pivot 120 and rests on the indicator stop 122 attached to the roof 114 when the roof 114 is in the closed position. The indicator 118 rotates about the pivot 120 in a plane. In some embodiments, the overhang of the roof 114 extends past the plane in which the indicator 118 rotates, and the indicator 118 is made long enough such that the indictor 118 rests in the initial position against an overhang of the roof 114 when the roof 114 is closed. When the roof 114 is rotated to the open position, the indicator 118 is rotated to a downward pointing direction under the force of gravity. In other embodiments, the indicator 118 rests in any direction in the initial position that is different from the position implying delivery.

In other embodiments, the indicator 118 is be placed on the enclosure 102. Other types of indicators 118 are also possible including a flag, a manual switch, a dial, a bell, or an electronic sensor. In some embodiments, it may be beneficial to use more than one indicator 118. For example, in the embodiment illustrated in FIG. 6, one indicator is placed on the apparatus 600 for visually indicating the delivery and another indicator such a bell to alert the building occupant about the delivery when they are inside the building.

Rather than or in addition to placing the indicator 118 on the outside of the apparatus 100, the inside of the enclosure 102 in some embodiments is equipped with sensors for detecting delivery of the parcel 303. For example, in some embodiments the base 106 is configured with pressure sensors or infrared sensors for detecting the delivery 303 and alerting the recipient about the parcel 303. The sensors are integrated into the cushion 132 at the base 106. The user can be notified in various ways including email, SMS, through an app, or a phone call, for example.

In some embodiments, the deflecting surface 140 is integrated with the enclosure 102 and one and the same with the sidewalls 104. The deflecting surface 140 is formed by bending the sidewalls 104 of the enclosure 102 such that a cross-section area of the upper portion 109 of the enclosure 102 is larger than a cross-section of the lower portion 130 of the enclosure 102, and the cross-section area of the lower portion 130 of the enclosure 102 is larger than a cross-section area of the basket opening 202 to allow articles to fall freely to the lower portion 130 of the enclosure 102. In other embodiments, the enclosure 102 has a taper, funnel shape, conical shape, hourglass shape or frustum cone shape.

In another embodiment, one or more additional plates are attached to the inner-side of the enclosure 102 and extend inward and downward at an angle toward the bottom 404 of the enclosure 102 thereby forming the deflecting surface 140. In some embodiments, the deflecting surface 140 is formed by an inward and downward extending ring that encircles the inside perimeter of the enclosure 102.

In the exemplary embodiment illustrated in FIG. 1, two ends of sheet metal panels are connected using the standing seam technique. In other embodiments, other techniques are used to connect the two ends of sheet metal panel. For example, other techniques include lap seam, countersunk lap seam, outside lap seam, flat lock seam, car strip seam, or grooved flat lock seam.

In the exemplary embodiments, sheet metal panels are also fastened by means of mechanical fastening using rivets. In other embodiments, other means of mechanical fastening are used. Other means of mechanical fastening include welding, machine screws and nut assembly, nails, rivets, press-fits, crimping, epoxy, double sided tape, very high bond tape, silicone sealant, or a combination thereof for example. It is possible to connect the sidewalls with just one type of mechanical fastening technique.

In the embodiment illustrated in FIG. 1, the sidewall 104 comprises of the first sidewall 802 and the second sidewall 804. In other embodiments, the sidewall 104 is fabricated from one sheet metal panel with three right angle bends and the two ends are connected by means of mechanical fastening. In another embodiment, the sidewall 104 is manufactured from one sheet metal panel and the two ends of the sidewall 104 are connected such that the enclosure 102 has a circular cross-section.

In the previously described embodiments, the basket 108 has the basket stop 138 that prevents the basket 108 from rotating past the upright position. In some embodiments, the basket stop 138 is placed on the inner side surface of the enclosure 102 to prevent the basket 108 from rotating past the upright position when the basket 108 impacts the basket stop 138. The basket stop 138 is integrated with the basket 108 in some embodiments so that they are one and the same. In some embodiments, a mechanical stop is attached to an outer side of the enclosure 102 to restrict the roof from going past the open position and to keep the basket 108 in the upright position. In other embodiments, the roof hinge 206 used to couple the roof 114 with the enclosure 102 is restricted to prevent its rotation past a set range. In some embodiments, the turntable bearings 110 or other type of rotation coupling mechanisms used to couple the basket 108 and the enclosure 102 are modified to only allow them to rotate within a set-range such that the basket 108 does not rotate past the upright position.

The turntable bearings 110 are beneficial in some embodiments over the use of gears as the turntable bearings' 100 robust design make them less likely to clog-up in case someone were to throw rocks or sand into the enclosure 102. The rotation mechanism can also be used as the enclosure stop 112.

In other embodiments, the turntable bearings 110 are attached to the enclosure 102 by other means of mechanical fastening. Means of mechanical fastening includes welding, machine screws and nut assembly, nails, rivets, epoxy, double sided tape, very high bond tape, silicone sealant, or a combination thereof for example.

Although the previously presented embodiments show the basket 108 rotatably coupled the enclosure 102 with the turntable bearings 110, some embodiments use other rotating mechanisms. Examples of rotating mechanisms include a pivot point, an axel/shaft, lazy-Susan bearings and other types of turntable bearings and bearings in general, a pin, gears, pulleys, belts, or a combination thereof.

In the exemplary embodiments described in FIGS. 1-7, the roof 114 has a gable shape to both prevent accumulation of rain water and snow on the top of the enclosure 102. However, many different shapes are possible for the roof 114 including a shed roof, a flat roof, a mansard roof, a hip roof, a pyramid roof, a gambrel roof, a saltbox roof, or a bonnet roof. In some embodiments, a roof style of the enclosure 102 is selected to match the same roof style that utilized on a building beside or nearby the enclosure 102. In other embodiments, the roof 114 has a handle for opening and closing the roof 114.

In the presented embodiments, the roof 114 is a rotatably coupled to the enclosure 102. However, other types of openable roofs are also possible. In some embodiments, the roof 114 slides within at least one rail connected to the enclosure 102 to move between the open position to allow access to the basket opening 202 and the closed position to block access to the basket opening 202. The roof 114 and the basket 108 are coupled with a connecting member 116 which may be a chain, for example. The chain is connected to the roof 114 at a first end and connected to the basket 108 at a second end. The rail is contoured such that sliding the roof 114 within the rail maintains adequate tension in the chain to apply a moment to rotate the basket 108 from the upright position to the upside-down position, and vice-versa. Opening the roof 114 rotates the basket opening 202 towards the top opening 204 of the enclosure 104 and closing the roof 114 rotates the basket opening 202 towards the bottom 404 of the enclosure 102.

In another embodiment, the connecting member 116 is a slider-crank mechanism; the slider-crank mechanism converts linear motion into rotary motion. The roof 114 is connected to a sliding end of the slider-crank mechanism and the basket 108 is connected to a rotating end of the slider-crank mechanism, whereby sliding the roof 114 along the rails rotates the basket 108.

In some embodiments, the enclosure 102 is anchored to the ground or another surface such as a building wall with an anchor. Various types of anchors are possible depending on the surface to which the enclosure 102 is to be secured including penetrator anchors, arrowhead anchors, or bullet anchors. In some embodiments as illustrated in FIG. 6, the enclosure 102 is anchored to the side of a building. In other embodiments, the apparatus 100 is anchored to a second apparatus by means of mechanical fastening. Alternatively, in some embodiments the apparatus 700 is anchored to the chute 702 by means of mechanical fastening. Means of mechanical fastening includes welding, machine screws and nut assembly, nails, rivets, press-fits, crimping, chains with a lock, belts, straps or a combination thereof for example.

In some embodiments, the enclosure bridge 606 in the exemplary embodiment illustrated in FIG. 6 is part of the apparatus 600. In other embodiments, the enclosure bridge 606 is part of the building 604. In another embodiment, the enclosure bridge 606 is a separate part. In yet other embodiments, the enclosure bridge 606 is omitted with the apparatus 600 secured directly against the building 604 such that the side opening 502 is directly adjacent and aligned with the building opening 602. In yet other embodiments, the apparatus 600 for receiving articles 303 may form a part of the building 604 itself and may be integral and built-in to the building wall during or after construction of the building 604.

In the presented embodiments, the door lock 136 used to secure the door 134 to prevent access to the side opening 502 is mechanical. However, in some embodiments, the door lock 136 is electronic/magnetic and opens with a code or fingerprint. Although the door lock 136 is mounted on the door 134 in the above-described embodiments, it is also possible to mount the door lock 136 on the enclosure 102 in other embodiments. Especially in embodiments where security is not a concern, the locking aspect of the lock may be omitted such that the door 134 still requires user interaction to open but any user could open the door 134. For instance, latches, clips, friction fit techniques and/or other non-locking means are mounted on one or more of the door 134 and the enclosure 102 in some embodiments to prevent the door 134 from inadvertently opening and spilling out the items received within the enclosure 102.

In the embodiment illustrated in FIG. 1, the door 134 is rotatably coupled to the enclosure 102 with the door hinge 506. In some embodiment, the door 134 slides within rails mounted to the enclosure 102 between the shut position and the ajar position.

The described embodiments are also suitable for delivery companies to pick up parcels from buildings; the delivery companies can be provided with keys to the door 134 for picking up articles from the enclosure. It is also possible to accommodate various parcel sizes and delivery volume by changing the size of the apparatus 100. In the described embodiments, anyone can open to the roof 114 to gain access to the basket opening 202. However, if desired, the roof 114 can be equipped with a roof lock for preventing unauthorized access to the basket opening 202.

All combinations and permutations of the above described features and embodiments may be utilized in conjunction with the invention.

What is claimed is:

1. An apparatus for receiving an article, the apparatus comprising:

an enclosure having a top opening through a top of the enclosure;

a basket located at least partially within the enclosure and rotatably coupled to the enclosure, the basket rotatable between an upright position in which a basket opening is rotated towards the top opening of the enclosure and an upside-down position in which the basket opening is rotated towards a bottom of the enclosure;

a roof of the enclosure moveable between an open position in which the basket is accessible from an outside of the enclosure through the top opening and a closed position in which the roof blocks access to the basket from the outside of the enclosure;

a connecting member coupling the roof with the basket, the connecting member configured such that movement of the roof to the open position rotates the basket to the upright position thereby allowing a user to place the article into the basket and movement of the roof to the closed position rotates the basket to the upside-down position thereby causing the article to drop out of the basket towards the bottom of the enclosure; and a deflecting surface extending toward an inner area of the enclosure from an inner-side surface of the enclosure;

wherein the deflecting surface does not extend past a basket sidewall of the basket when the basket is in the upside-down position, whereby the basket opening is unobstructed by the deflecting surface allowing the article to freely fall from the basket.

2. The apparatus of claim 1, wherein:

the basket is in an upper portion of the enclosure;

the basket in the upside-down position drops the article to a lower portion of the enclosure; and the enclosure has a side opening in the lower portion thereby allowing the article to be retrieved from the lower portion of the enclosure.

3. The apparatus of claim 2, wherein the apparatus is secured against a building and the side opening is accessed through the building.

4. The apparatus of claim 2, wherein the side opening of the enclosure is accessible through to a secured room.

5. The apparatus of claim 2, wherein the bottom of the enclosure has a bottom opening that is connected to a chute.

6. The apparatus of claim 2, wherein:

the enclosure comprises a plurality of sidewalls and a base on which the sidewalls are mounted;

the side opening is through one of the sidewalls; and the top opening is defined by the sidewalls opposite the base.

7. The apparatus of claim 6, wherein each of the enclosure, roof, and basket is a panel of sheet metal.

8. The apparatus of claim 6, wherein the base has a cushion on an inner-bottom surface of the enclosure.

9. The apparatus of claim 2, further comprising:

a door coupled to the enclosure; and a door lock;

wherein the door in a shut position blocks the side opening;

the door lock restricts the door to the shut position until unlocked; and the door in an ajar position allows access to the lower portion of the enclosure through the side opening.

10. The apparatus of claim 1, wherein the roof of the enclosure has a gable shape.

11. The apparatus of claim 2, wherein the basket is rotatably coupled to the upper portion of the enclosure with at least one turntable bearing on the inner-side surface of the enclosure.

12. The apparatus of claim 1, further comprising:

a basket stop on the basket that impacts the enclosure upon the basket being rotated into the upright position by movement of the roof to the open position;

wherein the roof in the open position has a center of gravity such that the roof under a force of gravity attempts to rotate the basket past the upright position; and the basket stop impacting the enclosure prevents the basket from continuing to rotate past the upright position.

13. The apparatus of claim 1, wherein the apparatus is secured by fastening at least one anchor to the enclosure.

14. The apparatus of claim 1, wherein the connecting member is a rigid arm comprising a first end and a second end, the connecting member is rotatably coupled to the roof at the first end and rotatably coupled to the basket at the second end.

15. The apparatus of claim 1, further comprising an indicator on an outer-side of the roof to indicate opening of the roof from the closed position, wherein opening of the roof implies delivery of the article.

16. The apparatus of claim 15, wherein:

the indicator is rotatably connected to the roof;

the indicator rests against an indicator stop in an initial position when the roof is in the closed position; and the indicator position is changed from the initial position to a position implying delivery by a force of gravity as the roof position moves from the closed position to the open position thereby the indicator indicates the roof was opened.

17. The apparatus of claim 1, wherein the roof has a roof lock to only allow authorized personnel to access the basket.

18. An apparatus for receiving an article, the apparatus comprising:

an enclosure having a top opening through a top of the enclosure;

a basket located at least partially within the enclosure and rotatably coupled to the enclosure, the basket rotatable between an upright position in which a basket opening is rotated towards the top opening of the enclosure and an upside-down position in which the basket opening is rotated towards a bottom of the enclosure;

a roof of the enclosure moveable between an open position in which the basket is accessible from an outside of the enclosure through the top opening and a closed position in which the roof blocks access to the basket from the outside of the enclosure;

a connecting member coupling the roof with the basket, the connecting member configured such that movement of the roof to the open position rotates the basket to the upright position thereby allowing a user to place the article into the basket and movement of the roof to the closed position rotates the basket to the upside-down position thereby causing the article to drop out of the basket towards the bottom of the enclosure; and a basket stop on the basket that impacts the enclosure upon the basket being rotated into the upright position by movement of the roof to the open position;

wherein the roof in the open position has a center of gravity such that the roof under a force of gravity attempts to rotate the basket past the upright position; and the basket stop impacting the enclosure prevents the basket from continuing to rotate past the upright position.

19. An apparatus for receiving an article, the apparatus comprising:

an enclosure having a top opening through a top of the enclosure;

a basket located at least partially within the enclosure and rotatably coupled to the enclosure, the basket rotatable between an upright position in which a basket opening is rotated towards the top opening of the enclosure and an upside-down position in which the basket opening is rotated towards a bottom of the enclosure;

a roof of the enclosure moveable between an open position in which the basket is accessible from an outside of the enclosure through the top opening and a closed position in which the roof blocks access to the basket from the outside of the enclosure; and a connecting member coupling the roof with the basket, the connecting member configured such that movement of the roof to the open position rotates the basket to the upright position thereby allowing a user to place the article into the basket and movement of the roof to the closed position rotates the basket to the upside-down position thereby causing the article to drop out of the basket towards the bottom of the enclosure;

wherein the basket is in an upper portion of the enclosure;

the basket in the upside-down position drops the article to a lower portion of the enclosure; and the bottom of the enclosure has a bottom opening that is connected to a chute.

20. An apparatus for receiving an article, the apparatus comprising:

an enclosure having a top opening through a top of the enclosure;

a basket located at least partially within the enclosure and rotatably coupled to the enclosure, the basket rotatable between an upright position in which a basket opening is rotated towards the top opening of the enclosure and an upside-down position in which the basket opening is rotated towards a bottom of the enclosure;

a roof of the enclosure moveable between an open position in which the basket is accessible from an outside of the enclosure through the top opening and a closed position in which the roof blocks access to the basket from the outside of the enclosure;

a connecting member coupling the roof with the basket, the connecting member configured such that movement of the roof to the open position rotates the basket to the upright position thereby allowing a user to place the article into the basket and movement of the roof to the closed position rotates the basket to the upside-down position thereby causing the article to drop out of the basket towards the bottom of the enclosure; and an indicator on an outer-side of the roof to indicate opening of the roof from the closed position, wherein opening of the roof implies delivery of the article;

wherein the indicator is rotatably connected to the roof;

the indicator rests against an indicator stop in an initial position when the roof is in the closed position; and the indicator position is changed from the initial position to a position implying delivery by a force of gravity as the roof position moves from the closed position to the open position thereby the indicator indicates the roof was opened.

* * * * *